US012235053B2

(12) United States Patent
Han et al.

(10) Patent No.: US 12,235,053 B2
(45) Date of Patent: Feb. 25, 2025

(54) HEAT EXCHANGER HAVING HEADER STRUCTURE FOR DISPERSING THERMAL STRESS

(71) Applicant: Hanon Systems, Daejeon (KR)

(72) Inventors: Ji Hun Han, Daejeon (KR); Byung Seon Cho, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 243 days.

(21) Appl. No.: 17/800,647

(22) PCT Filed: Feb. 19, 2021

(86) PCT No.: PCT/KR2021/002109
§ 371 (c)(1),
(2) Date: Aug. 18, 2022

(87) PCT Pub. No.: WO2021/167391
PCT Pub. Date: Aug. 26, 2021

(65) Prior Publication Data

US 2023/0341194 A1 Oct. 26, 2023

(30) Foreign Application Priority Data

Feb. 19, 2020 (KR) ..... 10-2020-0020166

(51) Int. Cl.
*F28F 9/02* (2006.01)
*F28D 1/053* (2006.01)

(52) U.S. Cl.
CPC ..... *F28F 9/0226* (2013.01); *F28D 1/05366* (2013.01); *F28F 9/0204* (2013.01); *F28F 2225/08* (2013.01)

(58) Field of Classification Search
CPC .... F28F 9/0226; F28F 9/0204; F28F 2225/08; F28F 9/0224; F28D 1/05366
See application file for complete search history.

(56) References Cited

U.S. PATENT DOCUMENTS

| | | | | |
|---|---|---|---|---|
| 5,664,625 | A | 9/1997 | Letrange et al. | |
| 2017/0038163 | A1* | 2/2017 | Hakamata | F28F 9/182 |
| 2018/0320995 | A1* | 11/2018 | Uno | F28D 1/05366 |

FOREIGN PATENT DOCUMENTS

| | | | |
|---|---|---|---|
| DE | 112016003219 | T5 | 5/2019 |
| JP | 2006189206 | A | 7/2006 |
| JP | 2016128730 | A | 7/2016 |

(Continued)

OTHER PUBLICATIONS

German Examination Report issued on Mar. 27, 2024 in corresponding application No. DE 11 2021 000 383.6, with English translation.

*Primary Examiner* — Tavia Sullens
*Assistant Examiner* — Khaled Ahmed Ali Al Samiri
(74) *Attorney, Agent, or Firm* — NORTON ROSE FULBRIGHT US LLP

(57) ABSTRACT

The present invention relates to a heat exchanger having a header structure for dispersing thermal stress. The purpose of the present invention is to provide a heat exchanger having a header structure for dispersing thermal stress, wherein the heat exchanger improves the structure of a tube insertion hole on a header so as to disperse as much thermal stress as possible, by focusing on the fact that thermal stress concentration mainly occurs in a tube nose.

4 Claims, 10 Drawing Sheets

(56) References Cited

FOREIGN PATENT DOCUMENTS

| | | | |
|---|---|---|---|
| JP | 2017075741 | A | 4/2017 |
| JP | 2018169058 | A | 11/2018 |
| JP | 2019090573 | A | 6/2019 |
| JP | 2019190796 | A | 10/2019 |
| KR | 20150078723 | A | 7/2015 |
| KR | 20170082865 | A | 7/2017 |
| WO | 2017013918 | A1 | 1/2017 |

* cited by examiner

R-R'

A-A'

B-B'

A-A'

A-A'

A-A'

Tensile Stress

Deformation (30x)

HEAT EXCHANGER HAVING HEADER STRUCTURE FOR DISPERSING THERMAL STRESS

CROSS REFERENCE TO RELATED APPLICATIONS

This application is a national phase under 35 U.S.C. § 371 of International Application No. PCT/KR2021/002109 filed on Feb. 19, 2021, which claims the benefit of priority from Korean Patent Application No. 10-2020-0020166 filed on Feb. 19, 2020. The entire contents of these applications are incorporated herein by reference in their entirety.

TECHNICAL FIELD

The present invention relates to a heat exchanger, and more particularly, to a heat exchanger having a header structure for dispersing thermal stress.

BACKGROUND ART

In general, an engine room of a vehicle may be provided with not only components for driving the vehicle, such as an engine, but also various heat exchangers such as a radiator, an intercooler, an evaporator and a condenser for cooling the respective components in the vehicle, such as the engine or for adjusting an air temperature of a vehicle interior. In general, these heat exchangers may each have a heat exchange medium circulating therein, and the heat exchange medium in the heat exchanger and air outside the heat exchanger may exchange heat with each other, thereby achieving cooling or heat dissipation.

The radiator may be a heat exchanger for cooling heat of the engine. A water jacket through which a coolant flows may be positioned in the engine, and heat occurring in the engine may be absorbed by the coolant in the water jacket to heat the coolant to have a high temperature. The high-temperature coolant may flow to the radiator, and exchange heat with the outside while passing through the radiator to have a low temperature again. The low-temperature coolant may flow into a circulation path through which the coolant flows back into the water jacket to absorb heat occurring in the engine.

A lot of heat may occur in the engine, and the coolant can thus have a temperature close to 100° C. when absorbing a lot of heat from the engine. However, the radiator may sufficiently dissipate heat to the outside, and the cooled coolant may thus be dropped to about 40° C. which is a much lower temperature. That is, there may be a large temperature difference between the high-temperature coolant flowing into the radiator (in a state of having heat absorbed from the engine) and the low-temperature coolant discharged from the radiator (in a state of being cooled by having heat dissipated to the outside).

As in the example of the radiator described above, the heat exchanger may generally have a temperature distribution significantly unbalanced due to the temperature of the heat exchange medium. When the temperature distribution is unbalanced as such, a degree of thermal deformation may vary depending on a position, and thermal stress may thus be concentrated on a specific portion of the heat exchanger. The thermal deformation may be a major cause of damage or crack of the heat exchanger, and thus, there is a need for a design to deal with this problem.

Korea Patent Laid-Open Publication No. 10-2017-0082865 (entitled "heat exchanger of bar plate type," published on Jul. 17, 2017, and hereinafter referred to as a 'related art document') discloses a technique related to a heat exchanger of a bar plate type, the heat exchanger including: a plurality of tubes each including an upper plate, a lower plate and an outer fin interposed therebetween, and stacked on each other; and a header combined with each of two ends of this tube stack, wherein a slimming portion, which becomes a plate-shaped member such as the upper or lower plate when unfolded, is positioned in a header bar positioned between the upper and lower plates at each of two ends of the heat exchanger. In the related art document, it is deemed that occurrence of residual stress due to repeated changes between a high temperature/a room temperature is caused by a difference between thicknesses of members connected to each other, and a slimming portion as described above is provided in order to reduce the difference between the thicknesses of connection portions between the header and the tube as much as possible.

The related art document discloses this technique to solve the thermal stress concentration and shape distortion due to the temperature change. However, the technique of the related art document may be limitedly applied to the heat exchanger of a bar plate type, and difficult to be generally applied to a fin-tube type heat exchanger, which is widely used. To briefly explain a structure of the fin-tube type heat exchanger, the fin-tube type heat exchanger may include a pair of header tanks each including a header and a tank combined with each other to have a shape of an enclosure, and positioned in parallel to each other while being spaced apart from each other by a predetermined distance; a plurality of tubes each having both ends fixed to the header tanks to form a flow path of a refrigerant; and fins interposed between the tubes. The heat exchanger of a bar plate type disclosed in the related art document includes the tube formed in a shape of a plate stack and the component such as the header bar according to this structure, and uses a method of solving the problem by using the slimming portion, which is a component further provided in the header bar. However, the fin-tube type heat exchanger may not include the components corresponding to the header bar, and it is thus difficult to use the slimming portion of the related art document. In addition, in the related art document, it is deemed that reducing the difference between the thicknesses of the components connected to each other is a method of solving the problem. However, a thickness of the header tank and a thickness of the tube may be basically quite different from each other, it is impossible to change this difference, and it is thus also difficult to use the idea of the related art document.

It is thus essential to develop a design for effectively dispersing the thermal stress concentration caused by the unbalanced temperature distribution in the fin-tube type heat exchanger.

RELATED ART DOCUMENT

Patent Document

1. Korean Patent Laid-Open Publication 10-2017-0082865 (entitled "heat exchanger of bar plate type," and published on Jul. 17, 2017)

DISCLOSURE

Technical Problem

An object of the present invention is to provide a heat exchanger having a header structure for dispersing thermal stress, in which a tube insertion hole in the header has an improved structure for the thermal stress to be dispersed as much as possible, by focusing on the fact that thermal stress concentration mainly occurs in a tube nose.

Technical Solution

In one general aspect, a heat exchanger 1000 having a header structure for dispersing thermal stress includes a pair of header tanks 100 each including a header 110 and a tank 120 combined with each other, and positioned in parallel to each other while being spaced apart from each other by a predetermined distance; and a plurality of tubes 200 each having both ends fixed to the header tanks 100 to form a flow path of a refrigerant, wherein the header 110 extends in one direction and includes a plurality of tube insertion holes 115 into which the tube 200 is inserted, and for the at least one tube insertion hole 115, the header 110 includes a slope portion S in which a wall surface of the header 110 in contact with the tube 200 is inclined to the tube 200 in a cross-section thereof in the width direction at a position of the tube insertion hole 115.

In more detail, the header 110 may have a bottom surface 111 formed on a plane formed in a length direction and a width direction thereof, a side surface 112 bent from the bottom surface 111 and extending in a height direction thereof, a hole formation portion 113 in which an inner partial portion of the bottom surface 111 protrudes into the header tank 100 and the plurality of tube insertion holes 115 are formed, and an inner wall surface 114 formed between the bottom surface 111 and the hole formation portion 113, and the slope portion S may have an angle inclined between the bottom surface 111 and the inner wall surface 114 in the cross-section in the width direction at the position of the tube insertion hole 115.

Here, for the tube insertion hole 115 having the slope portion S formed therein, the header 110 may have the angle between the bottom surface 111 and the inner wall surface 114 which is an obtuse angle with respect to the bottom surface 111 in the cross-section in the width direction at the position of the tube insertion hole 115.

In addition, the header 110 may accommodate a gasket 130 in a space formed between the side surface 112 and the inner wall surface 114 to secure airtightness between the header 110 and the tank 120 of the header tank 100, and for the tube insertion hole 115 having no slope portion S formed therein, the header 110 may include a misassembly prevention portion P for preventing the gasket 130 from being deviated from its correct position by having the angle between the bottom surface 111 and the inner wall surface 114 less inclined than the slope portion S or perpendicular, in the cross section in the width direction at the position of the tube insertion hole 115.

In addition, the header 110 may accommodate a gasket 130 in a space formed between the side surface 112 and the inner wall surface 114 to secure airtightness between the header 110 and the tank 120 of the header tank 100, and include a misassembly prevention portion P for preventing the gasket 130 from being deviated from its correct position by having the angle between the bottom surface 111 and the inner wall surface 114 less inclined than the slope portion S or perpendicular, in the cross section in the width direction at a position between the tube insertion holes 115.

In addition, the slope portion S may be formed over an entire range of the inner wall surface 114, or formed in a partial range of the inner wall surface 114 adjacent to the tube 200 and a periphery connection portion P' in which the angle between the bottom surface 111 and the inner wall surface 114 is less inclined than the slope portion S or perpendicular may be formed in the other portion of the inner wall surface 114.

In addition, the header 110 may include a contact extension portion 116 in which an inner partial region of the hole formation portion 113 is recessed to the outside of the header tank 100. Here, the contact extension portion 116 may be formed in a region including the tube insertion hole 115 having the slope portion S formed therein.

In addition, in the header 110, the tube insertion hole 115 having the slope portion S formed therein may be formed within a deformation range extending in the length direction from its position corresponding to a position of an inlet, through which a heat exchange medium is introduced into the header tank 100, on the header 110. Here, the deformation range may have a value within a range of 40 to 60 mm.

Advantageous Effects

According to the present invention, it is possible to effectively prevent the thermal stress concentration from occurring in the heat exchanger due to the unbalanced temperature distribution of the heat exchange medium. In more detail, the present invention may have the improved header structure that effectively disperses the thermal stress in the circumferential direction of the tube by allowing the cross-section of the tube insertion hole connected to the tube nose, which is the region where the thermal stress concentration mainly occurs, to be inclined and by increasing the cross-sectional area of the tube insertion hole in contact with the two surfaces of the tube. It is thus possible to greatly reduce the damage and crack occurring in the connection portions between the header and the tube by effectively dispersing the thermal stress.

In addition, the header structure of the present invention can be formed by simply replacing a mold in a conventional header manufacturing process, and thus have excellent compatibility with the conventional header and heat exchanger manufacturing process.

DESCRIPTION OF REFERENCE NUMERALS

Figure 1:
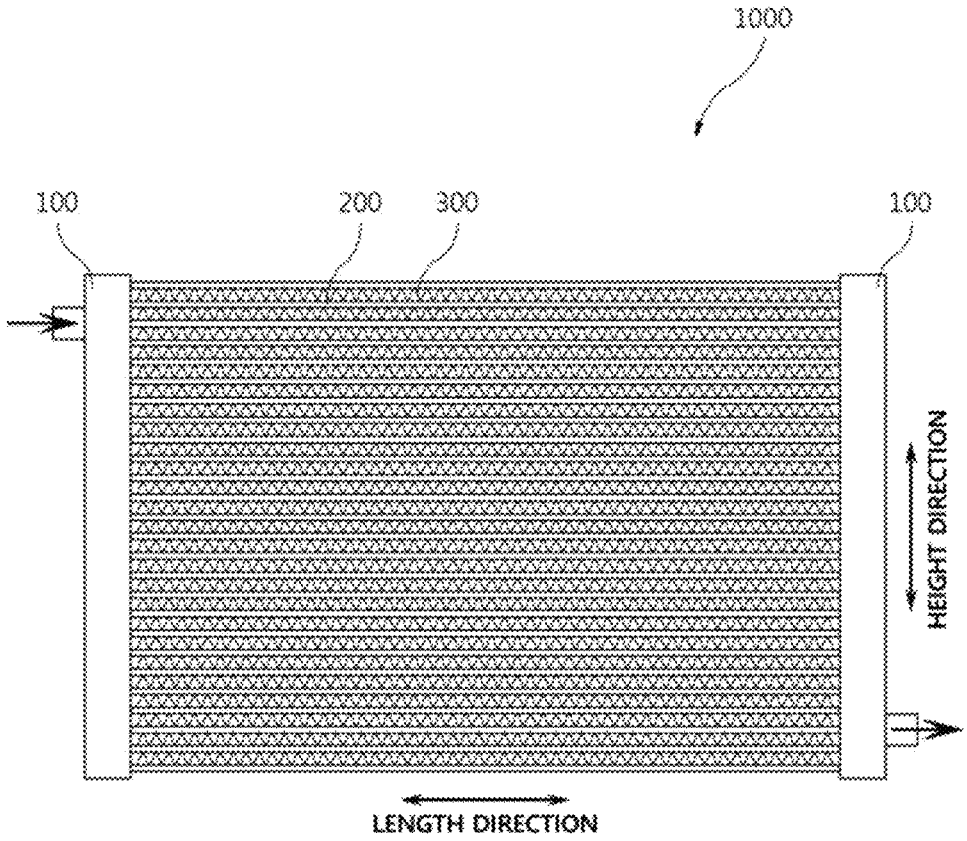
FIG. 1 shows a general heat exchanger.

1000: heat exchanger
100: header tank
110: header
120: tank 130: gasket
200: tube 300: fin

BEST MODE

Hereinafter, a heat exchanger having a header structure for dispersing thermal stress according to the present invention, having the above-described configuration, is described in detail with reference to the accompanying drawings.

Figure 2:
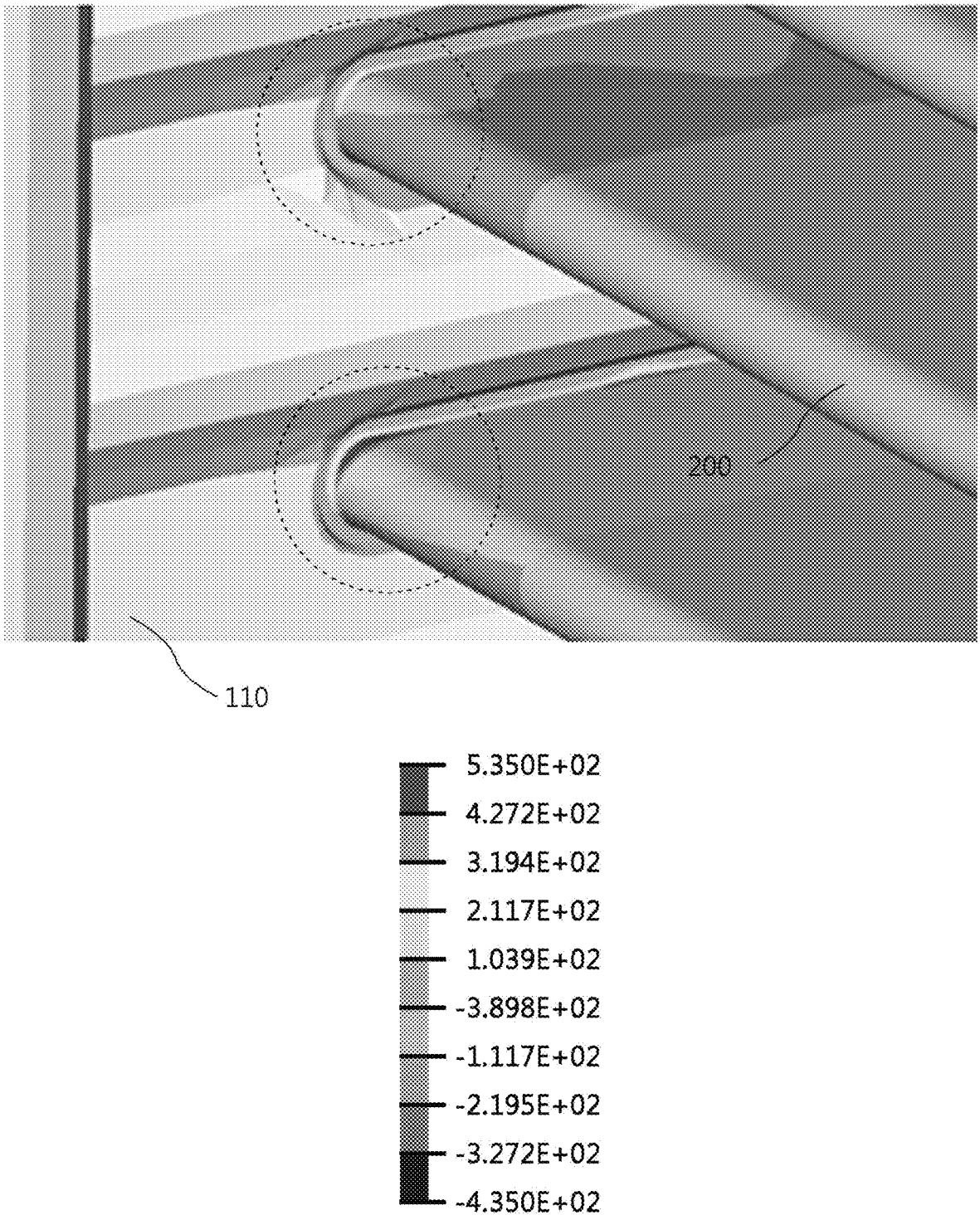
FIG. 2 shows an example of thermal stress concentration on a tube nose.

FIG. 1 shows a general heat exchanger. The heat exchanger shown in FIG. 1 may be a general fin-tube type heat exchanger, include a pair of header tanks 100 positioned in parallel to each other while being spaced apart from each other by a predetermined distance and a plurality of tubes 200 each having both ends fixed to the header tanks 100 to form a flow path of a refrigerant, and further include a plurality of fins 300 interposed between the tubes 200. As described above, a temperature distribution formed in the heat exchanger may be very non-uniform and a temperature of a heat exchange medium flowing through the heat exchanger may also change significantly, and a degree of thermal deformation may vary depending on a position of the heat exchanger, which can cause the thermal stress. A crack may occur due to continuous stress concentration and fatigue damage for a long time when the thermal stress is concentrated on a portion having relatively weak rigidity than another portion, such as a portion having a smaller thickness than another portion or a region where components are connected to each other. In general, a combination of the header tank 100 and the tube 200 may be made in such a way that each of the plurality of the tubes 200 is inserted into a hole formed in the header tank 100 and then brazed. Here, it is well known that the brazed portion is a representative weak portion, and many cracks occur due to the thermal stress concentration on a region where the header tank and the tube are combined with each other as described above. A tube nose region may be a portion where the thermal stress more tends to be particularly concentrated among the regions where the header tank and the tube are combined with each other. FIG. 2 shows an example of the thermal stress concentration on the tube nose, and as indicated by a dotted circle in the drawing, it can be seen that the tube nose region exhibits a higher thermal stress than another portion.

Figure 3:
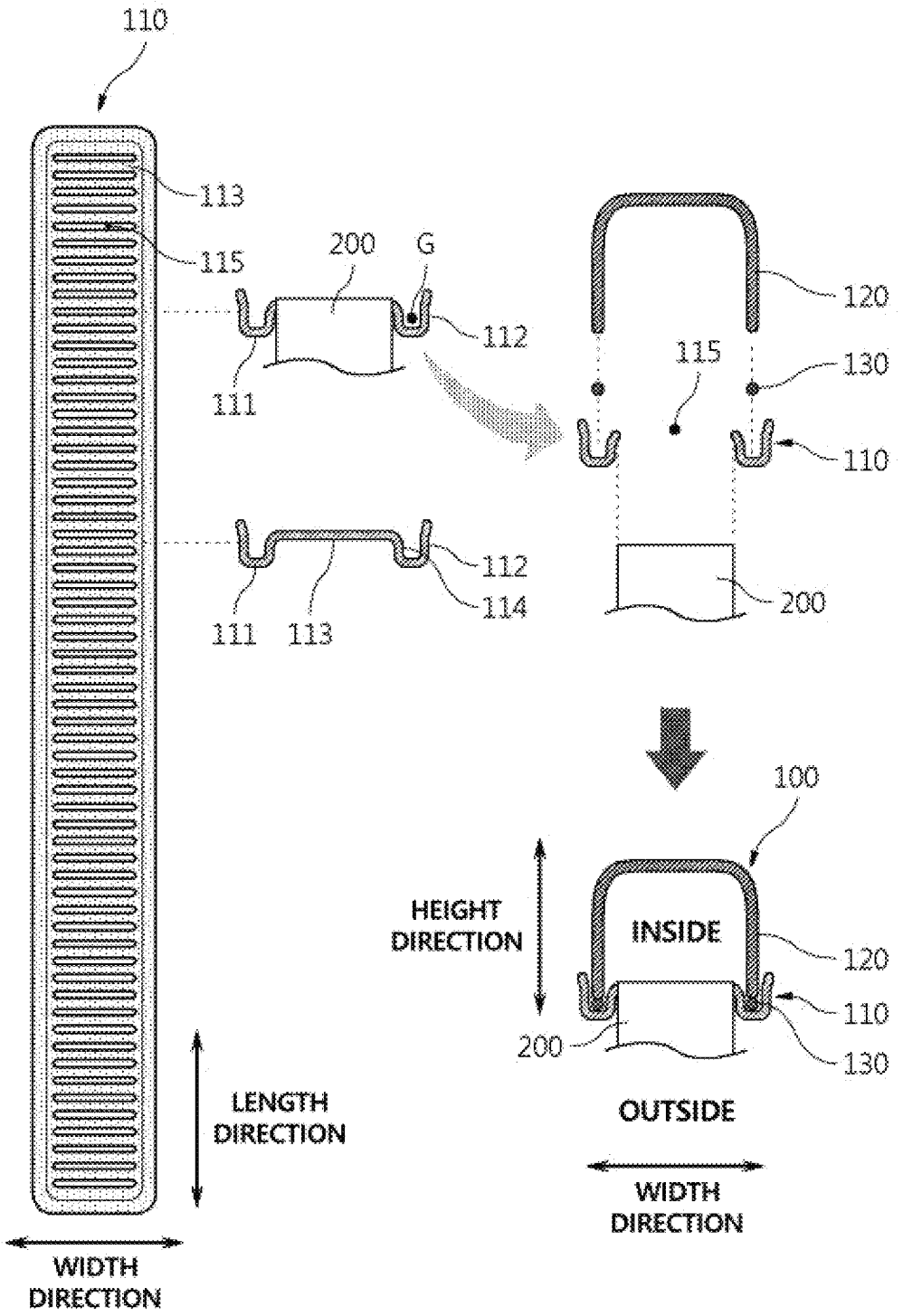
FIG. 3 shows general header shape and header tank structure.

FIG. 3 shows general header shape and header tank structure. As shown in the right cross-sectional view of FIG. 3, the header tank 100 may include a header 110 with which the tube 200 is combined, and a tank 120 combined with the header 110 to have a space in which the heat exchange medium is accommodated and flows. That is, the header tank 100 may have a shape of an enclosure by combining the header 110 and the tank 120 with each other. As shown in the upper left view of FIG. 3, the header 110 may have a shape of an approximate rectangle extending in one direction when viewed from the inside of the header tank 100, and a plurality of tube insertion holes 115 to which the plurality of the tubes 200 are inserted and combined. In addition, the header 110 may include a bottom surface 111, a side surface 112, a hole formation portion 113 and an inner wall surface 114. Hereinafter, each portion is described in more detail, and in the following description, a length direction may indicate a long-axis direction of the rectangle, a width direction may indicate a short-axis direction of the rectangle, and a height direction may indicate a direction perpendicular to the length direction and the width direction.

The bottom surface 111 may be a surface formed on a plane formed in the length direction and the width direction, and generally regarded as a representative reference surface of the header 110.

The side surface 112 may be a surface bent from the bottom surface 111 and extending in the height direction, and connected and combined with a lower end of the side surface of the tank 120, as shown in the right cross-sectional view of FIG. 3. In particular, various means for increasing a combination force with the tank 120 may be formed at the end of the side surface 112. However, the present invention is not an invention related to the header-tank combination, and a description thereof is thus omitted.

The hole formation portion 113 may be a surface in which the plurality of tube insertion holes 115 are formed, and an inner partial portion of the bottom surface 111 protrudes into the header tank 100. That is, when viewed from the outside of the header tank 100, the hole formation portion 113 may have a concave shape compared to that of its edge portion. The header 110 may have and an approximate shape of a rectangle, the hole formation portion 113 may also have an approximate shape of a rectangle as shown in the upper left view of FIG. 3. The hole formation portion 113 may have such a shape, and the connection portion between the header 110 and the tube 200 may thus be disposed in a space slightly hidden from the outside. It is thus possible to prevent an impact of a foreign material such as sand that is thrown from the ground to some extent.

The inner wall surface 114 may be a surface formed between the bottom surface 111 and the hole formation portion 113. As shown in the right cross-sectional view of FIG. 3, a gasket 130 may be accommodated in a space formed between the side surface 112 and the inner wall surface 114. The gasket 130 may be generally made of an elastic material, interposed in a region where the header 110 and the tank 120 are combined with each other, and thus be deformed as the header and the tank are combined with each other to serve to block a gap which may occur in the region where the header 110 and the tank 120 are combined with each other, that is, to secure airtightness between the header 110 and the tank 120.

As described above, the thermal stress may be concentrated on various positions on the heat exchanger 1000 due to the non-uniform temperature distribution and the temperature change of the heat exchange medium, in the heat exchanger 1000. In particular, it is well known that this tendency is greater when the heat exchanger 1000 is a radiator. Here, a region most vulnerable to the thermal stress concentration on the heat exchanger 1000 may be the region where the header tank and the tube are combined with each other, especially the tube nose region.

In the present invention, the thermal stress concentrated on the tube nose may be dispersed by improving a structure of the region where the header tank and the tube are combined with each other. In detail, for the at least one tube insertion hole 115, the header may include a structure of a slope portion S in which a wall surface of the header 110 in contact with the tube 200 is inclined to the tube 200, in a cross-section thereof in the width direction at a position of the tube insertion hole 115. To define the slope portion S by using each detailed portion of the header 110 described above, the slope portion S may have a structure in which an angle between the bottom surface 111 and the inner wall surface 114 is inclined in the cross-section in the width direction at the position of the tube insertion hole 115.

The thermal stress concentration may be stronger in a periphery of an inlet on the header 110, through which the heat exchange medium is introduced into the header tank 100, and it is thus preferable that the tube insertion hole 115 having the slope portion S formed therein is also formed within a preset range extending in the length direction from its position corresponding to a position of the inlet, through which the heat exchange medium is introduced into the header tank 100, on the header 110. When the range here is referred to as a deformation range, it is empirically known that the crack in the region where the header 110 and the tube 200 are combined with each other may occur in a range of about 50 mm from the position corresponding to the position of the inlet on the header 110 due to the thermal stress concentration, and the deformation range can thus be determined to have a value within a range of 40 to 60 mm.

Figure 4:
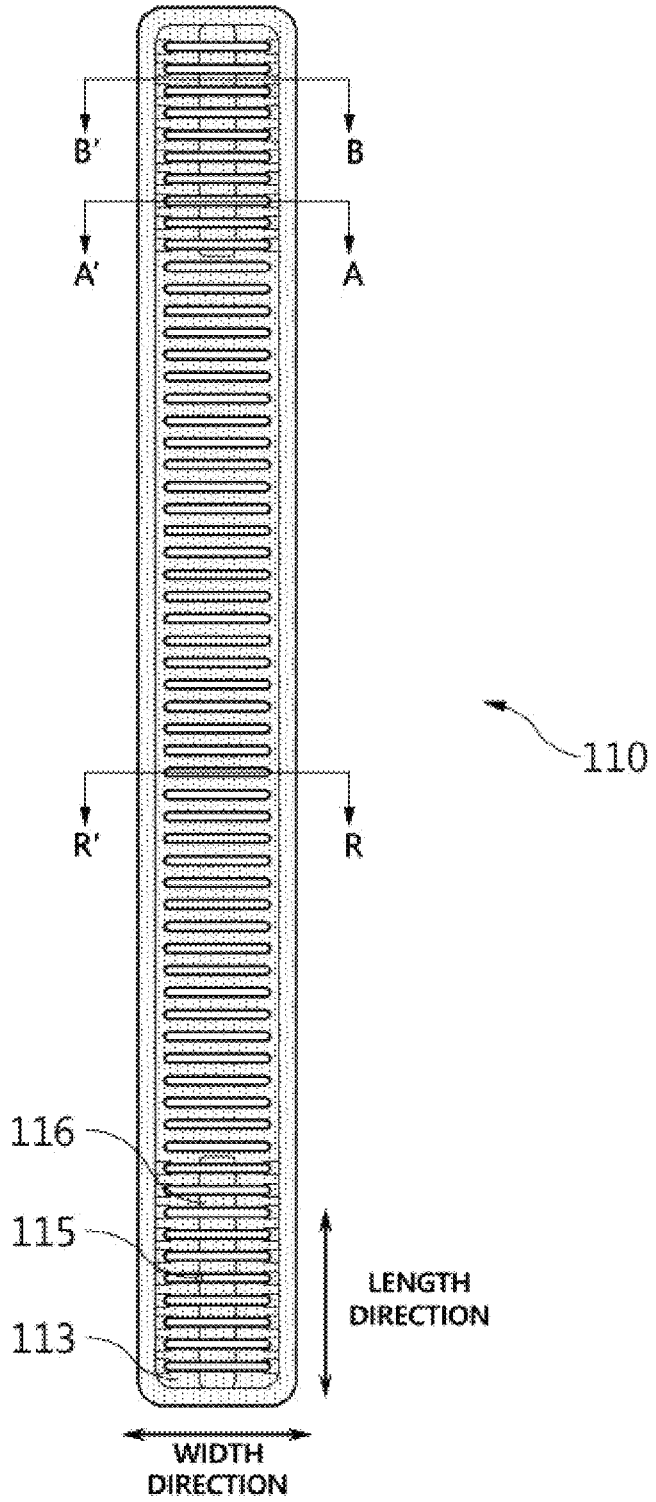
FIG. 4 is a top view of the header according to the present invention.

FIG. 4 is a top view of the header according to the present invention. As described above, when the length direction indicates the long-axis direction of the header 110, the width direction indicates the short-axis direction thereof and the height direction indicates the direction perpendicular to these directions, it can be confirmed where and how an improved structure of the present invention is applied through the top view of FIG. 4 although it is not possible to confirm a cross-sectional shape of the tube insertion hole 115 having the improved structure of the present invention from the top view of FIG. 4. In FIG. 4, portion R-R' may indicate the position of the tube insertion hole having no improved structure, portion A-A' may indicate the position of the tube insertion hole having the improved structure, and portion B-B' may indicate the position in a periphery of the tube insertion hole having the improved structure, respectively. Hereinafter, the respective portions are described in more detail.

Figure 5:
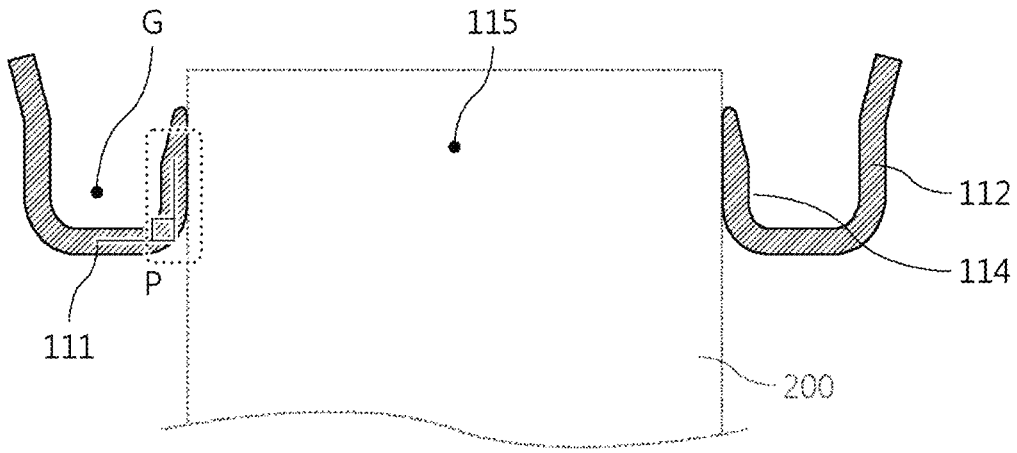
FIG. 5 is a cross-sectional view of portion R-R' (i.e. tube insertion hole having no improved structure) of the header according to the present invention.

FIG. 5 is a cross-sectional view of portion R-R' (i.e. tube insertion hole having no improved structure) of the header according to the present invention. As described above, a position of portion R-R' may be the position of the tube insertion hole having no improved structure of the present invention, and in other words, may show the same shape as a conventional tube insertion hole. As well shown in FIG. 5, the tube insertion hole having no improved structure may include a misassembly prevention portion P for preventing the gasket 130 from being deviated from its correct position by having the angle between the bottom surface 111 and the inner wall surface 114 less inclined than the slope portion S or perpendicular, in the cross section in the width direction at the position of the tube insertion hole 115 (the misassembly prevention portion P is described in more detail below). In the drawing, it can be seen that the inner wall surface 114 and the tube 200 maintain a predetermined distance. However, in reality, a brazing material may be applied to the tube insertion hole 115, the tube 200 may then be inserted into the tube insertion hole 115, and a brazing process may be performed. Therefore, in reality, almost an entire area of the inner wall surface 114 perpendicularly standing may be combined with the tube 200 by brazing. Here, the portion where the tube 200 is combined with the inner wall surface 114 may be the tube nose region. However, in the prior art, the thermal stress is rather concentrated on the tube nose region due to the structure as described above.

Figure 6:
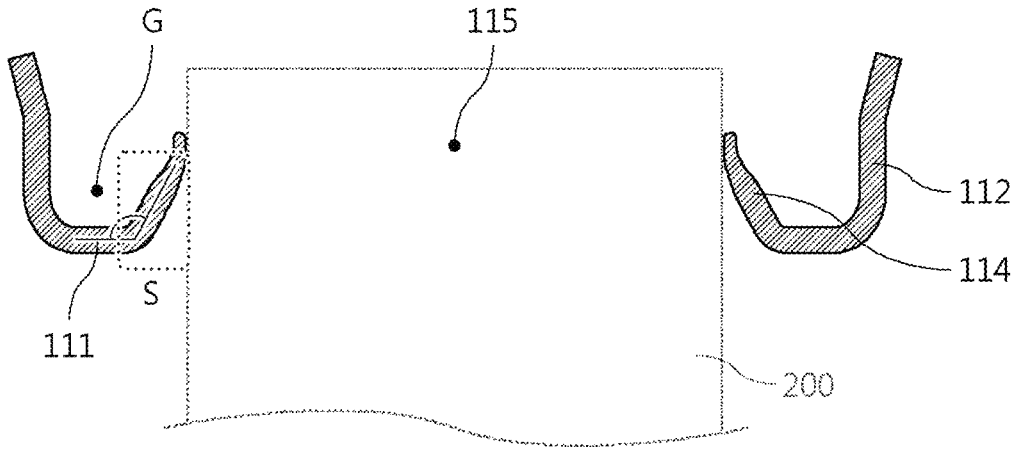
FIG. 6 is a cross-sectional view of portion A-A' (i.e. tube insertion hole having an improved structure) of the header according to the present invention.

FIG. 6 is a cross-sectional view of portion A-A' (i.e. tube insertion hole having the improved structure) of the header according to the present invention. As described above, the position of portion A-A' may be the position of the tube insertion hole having the improved structure of the present invention. To more clearly explain the improved structure of the present invention, the angle between the bottom surface 111 and the inner wall surface 114 may be inclined in the cross-section in the width direction at the position of the tube insertion hole 115. In more detail, the angle between the bottom surface 111 and the inner wall surface 114 may be an obtuse angle with respect to the bottom surface 111 as shown in FIG. 6. A length of the combination region by brazing formed in the nose region of the tube 200 may be reduced compared to that of the prior art by having such a structure, and thus the thermal stress concentrated on the nose region of the tube 200 can be dispersed.

Figure 7:
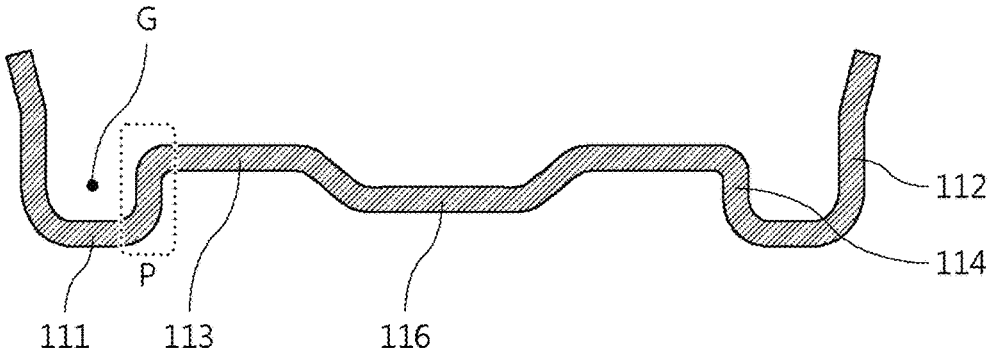
FIG. 7 is a cross-sectional view of portion B-B' (i.e. periphery of the tube insertion hole having the improved structure) of the header according to the present invention.

FIG. 7 is a cross-sectional view of portion B-B' (i.e. periphery of the tube insertion hole having the improved structure) of the header according to the present invention. As explained with reference to FIG. 6, in the present invention, the inner wall surface 114 combined with the nose of the tube 200 may be inclined in order to disperse the thermal stress concentrated on the nose region of the tube 200. Meanwhile, as described above, the inner wall surface 114 may serve to accommodate the gasket 130 together with the side surface 112. Here, when the inner wall surface 114 is inclined inwardly, the gasket 130 may not be stably disposed in the correct position and deviated. In order to prevent this problem, the misassembly prevention portion P for preventing the gasket 130 from being deviated from its correct position is formed in a position other than the position of the tube insertion hole 115, i.e. at a position between the tube insertion holes 115, by having the angle between the bottom surface 111 and the inner wall surface 114 less inclined than the slope portion S or perpendicular as in the prior art, in the cross-section in the width direction. Here, it is explained that the periphery of the tube insertion hole having the improved structure may have such a structure (i.e., structure in which the bottom surface and the inner wall are perpendicular to each other to prevent the gasket from being deviated from the correct position), and the periphery of the tube insertion hole having no improved structure may also have such a structure. In addition, the slope portion S is to prevent the thermal stress from occurring at a specific position, and the misassembly prevention portion P is to prevent the gasket 130 from being deviated from the correct position, and the position of the tube insertion hole having no improved structure may also have such a structure. The above explanation is in the same context in which the description previously made with reference to FIG. 5, that is, the cross-sectional view of portion R-R' (i.e. tube insertion hole having no improved structure) explains that the misassembly prevention portion P is formed in the tube insertion hole having no improved structure (that is, the conventional tube insertion hole).

Meanwhile, the description with reference to FIG. 6 explains that in the present invention, the inner wall surface 114 is inclined in the nose region of the tube 200 to reduce a combination area in the nose region of the tube 200, thereby preventing the thermal stress concentration. However, an overall combination force in a peripheral direction (i.e. circumferential direction) of the tube 200 may also be reduced when only the combination area on the nose portion of the tube is reduced as such.

Figure 8:
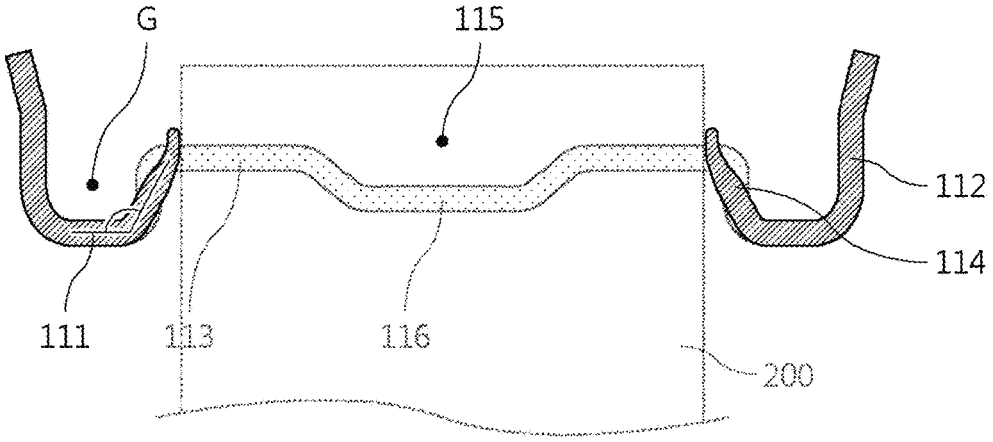
FIG. 8 is a view overlapping the cross-sectional view of portion A-A' (i.e. tube insertion hole having the improved structure) of the header according to the present invention and the cross-sectional view of portion B-B' (i.e. periphery of the tube insertion hole having the improved structure) of the header with each other.

In order to solve this problem, the present invention may further introduce a structure for increasing the combination area on wide two surfaces of the tube 200 (that is, the surfaces other than that of the nose region). In more detail, as shown in FIG. 7, the header 110 may include a contact extension portion 116 in which an inner partial region of the hole formation portion 113 is recessed to the outside of the header tank 100. As described above, the contact extension portion 116 may be a region included in a region in contact with the wide two surfaces of the tube 200, and the combination area in the region in contact with the wide two surfaces of the tube 200 may be increased by forming the contact extension portion 116. FIG. 8 is a view overlapping the cross-sectional view of portion A-A' (i.e. tube insertion hole having the improved structure) of the header according to the present invention and the cross-sectional view of portion B-B' (i.e. periphery of the tube insertion hole having the improved structure) of the header with each other, and through FIG. 8, it can be more intuitively confirmed that the region in contact with the wide two surfaces of the tube 200 is widened by the contact extension portion 116.

That is, in short, the combination area may be reduced in the nose region of the tube 200 (by inclining the inner wall surface), and the combination area may be increased in the wide two surface region of the tube 200 (by forming the contact extension portion). In this way, it is possible to effectively disperse the thermal stress while eliminating a loss of the overall combination force in the circumferential direction of the tube 200. In order to properly obtain this effect, it is preferable that the contact extension portion 116 is formed in a range including the tube insertion hole having the improved structure of the present invention, that is, in a range including some tube insertion holes 115 in which the angle between the bottom surface 111 and the inner wall surface 114 is inclined.

In the above-described portion A-A' (i.e. tube insertion hole having the improved structure) according to an exemplary embodiment, the slope portion S may be formed over an entire range of the inner wall surface 114. However, in FIG. 8, when overlapping and comparing the cross-section of portion A-A' (i.e. tube insertion hole having the improved structure) and the cross-section of portion B-B' (i.e. periphery of the tube insertion hole having the improved structure) with each other, the cross-sections show shapes significantly different from each other at the position of the inner wall surface 114. Therefore, when such shapes are actually applied, a significant distortion may occur in a portion where the two shapes are connected to each other, and there is a risk of damage occurring in a manufacturing process.

Figure 9:
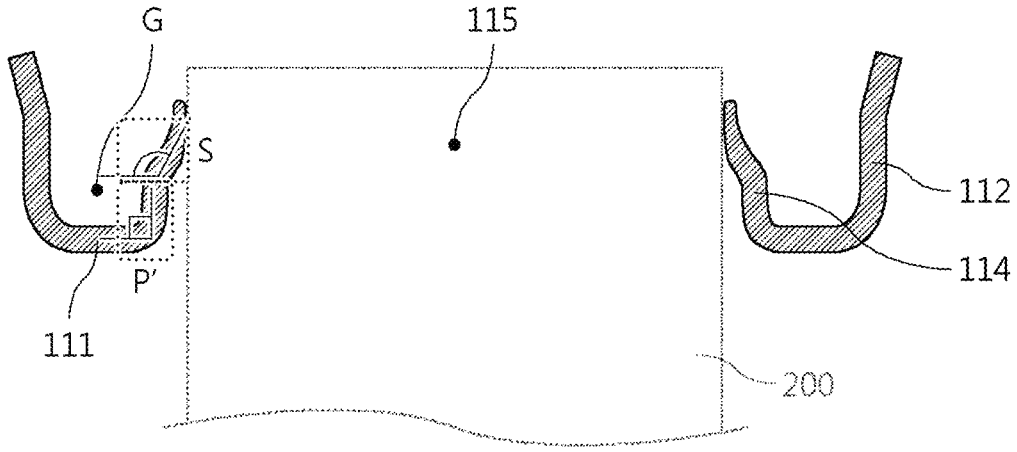
FIG. 9 is a cross-sectional view of portion A-A' (i.e. tube insertion hole having an improved structure) of the header according to another exemplary embodiment of the present invention.
Figure 10:
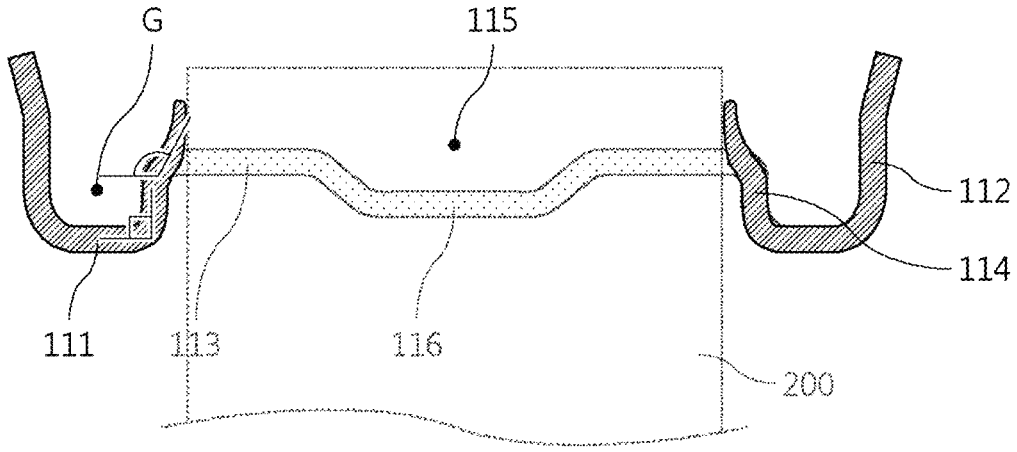
FIG. 10 is a view overlapping the cross-sectional view of portion A-A' (i.e. tube insertion hole having the improved structure) of the header according to another exemplary embodiment of the present invention and a cross-sectional view of portion B-B' (i.e. periphery of the tube insertion hole having the improved structure) of the header with each other.

In order to avoid this problem, the slope portion S may be formed over a partial range of the inner wall surface 114 adjacent to the tube 200 to further reduce the distortion in the portion where the two shapes are connected to each other. FIG. 9 is a cross-sectional view of portion A-A' (i.e. tube insertion hole having an improved structure) of the header according to another exemplary embodiment of the present invention. As shown in FIG. 9, the slope portion S may be formed in the partial range of the inner wall surface 114 adjacent to the tube 200, and thus obtain the effects (less stress concentration on the nose region or the like) as described above with reference to FIG. 6. Meanwhile, a periphery connection portion P' in which the angle between the bottom surface 111 and the inner wall surface 114 is less inclined than the slope portion S or perpendicular may be formed in the other portion of the inner wall surface 114 to correspond to a shape of the periphery B-B' of the tube insertion hole. FIG. 10 is a view overlapping the cross-sectional view of portion A-A' (i.e. tube insertion hole having the improved structure) of the header according to another exemplary embodiment of the present invention and a cross-sectional view of portion B-B' (i.e. periphery of the tube insertion hole having the improved structure) of the header with each other. When manufactured in this way, the shapes of the inner wall surface 114 at the position of the tube insertion hole and the position of the periphery of the tube insertion hole may be almost similar to each other, thereby greatly reducing the risk of distortion and damage occurring in the manufacturing process described above.

Figure 11:
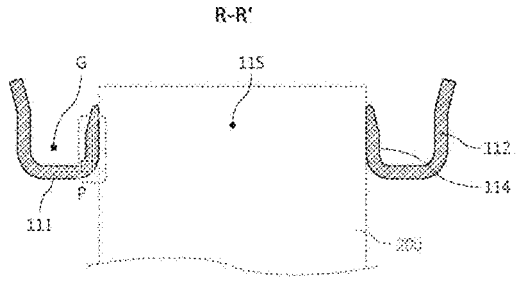
FIG. 11 shows a tensile stress and a deformation distribution in portion R-R' of the header according to the present invention.
Figure 11:
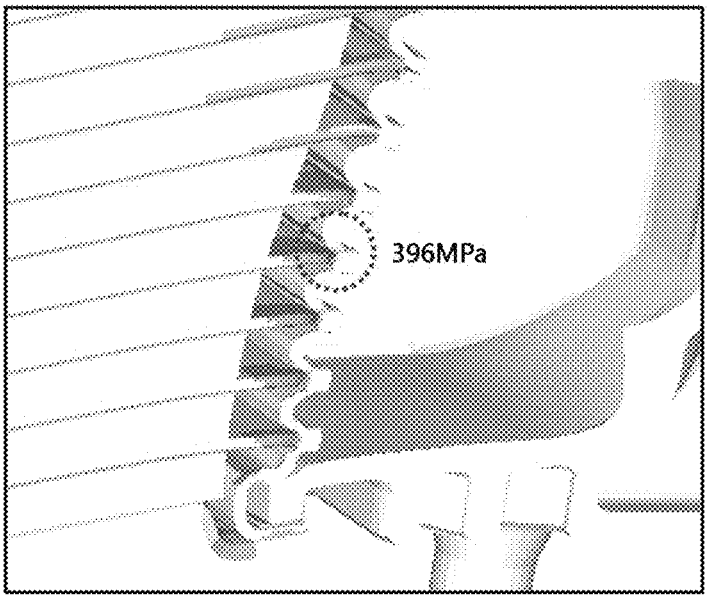
Figure 11:
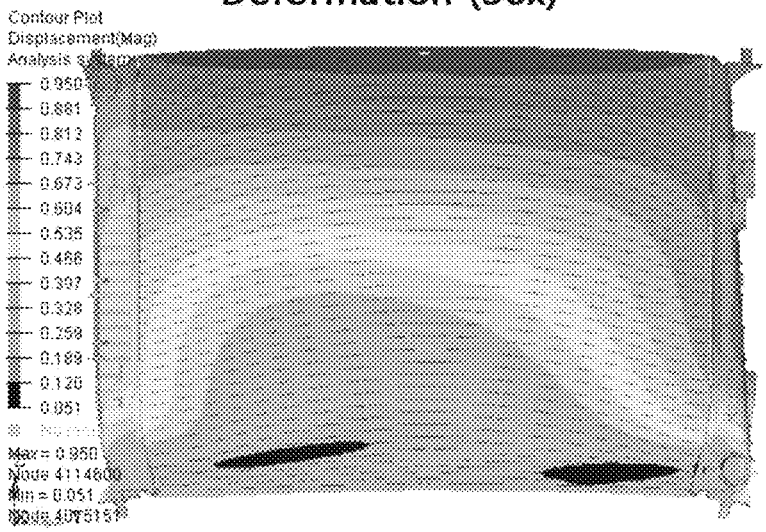
Figure 12:
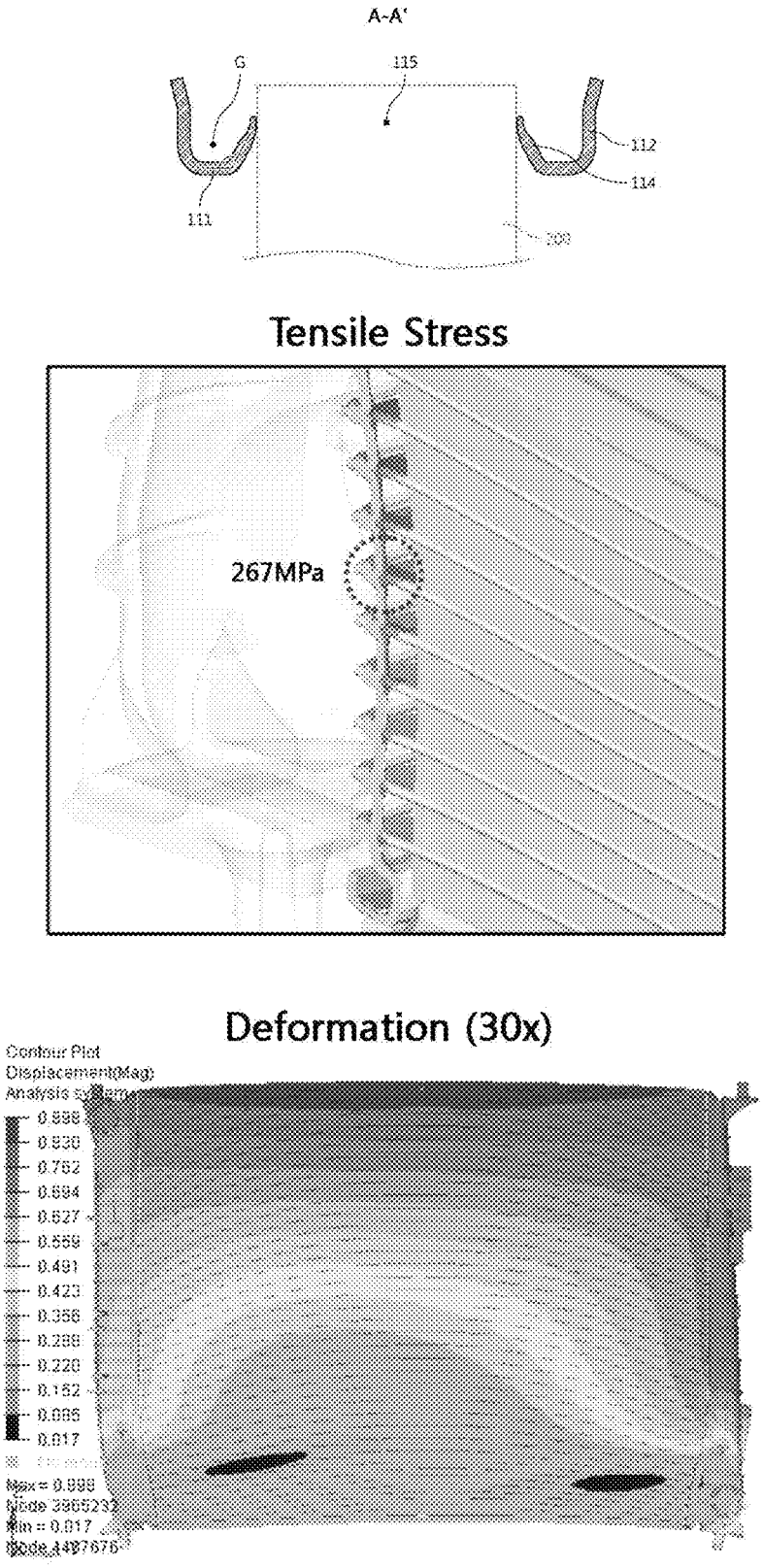
FIG. 12 shows a tensile stress and a deformation distribution in portion A-A' of the header according to the present invention.

FIG. 11 shows a tensile stress and a deformation distribution in portion R-R' of the header according to the present invention, and FIG. 12 shows a tensile stress and a deformation distribution in portion A-A' of the header according to the present invention. As described above, the position of portion R-R' may be the position of the tube insertion hole having no the improved structure of the present invention, and the position of portion A-A' may be the position of the tube insertion hole having the improved structure of the present invention.

Figure 13:
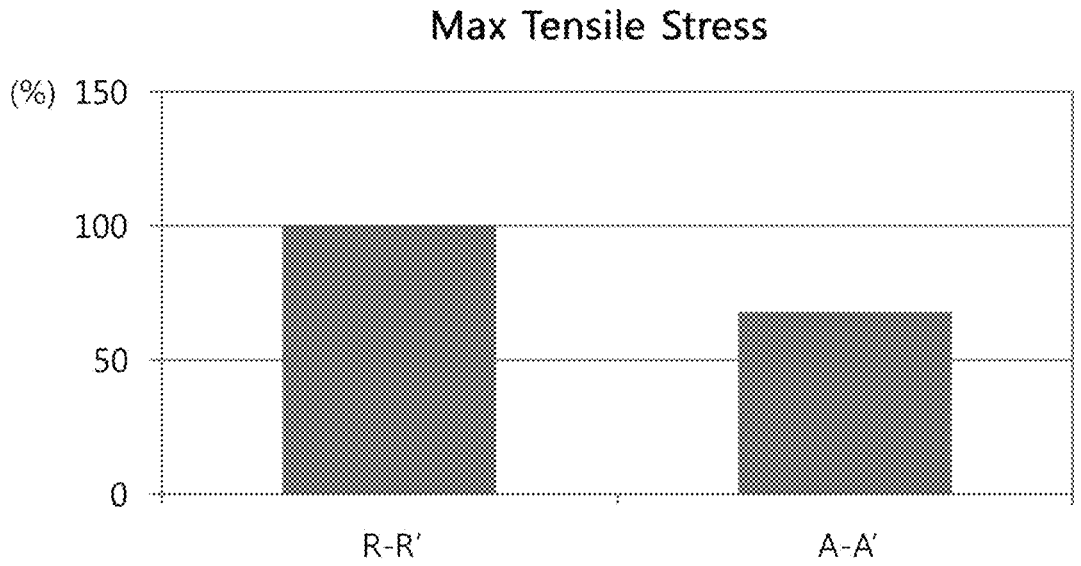
FIG. 13 shows a comparison of a maximum tensile stress in portion R-R' and portion A-A'.

When comparing FIGS. 11 and 12 to each other, the tensile stress in portion R-R' is 396 MPa, whereas the tensile stress in portion A-A' is 267 MPa, thus confirming that the thermal stress in the tube nose is greatly reduced. In addition, when comparing the deformation distributions to each other, it is confirmed that the deformation in a periphery of the header is greatly reduced in portion A-A' than in portion R-R'. FIG. 13 shows a comparison of a maximum tensile stress in portion R-R' and portion A-A', and the maximum tensile stress in portion A-A' (having the improved structure) is reduced to about 70% of that in portion R-R' (having no improved structure). As such, it can be confirmed that the thermal stress occurring on the tube nose may be effectively dispersed by using the improved structure of the present invention.

The present invention is not limited to the abovementioned exemplary embodiments, and may be variously applied. In addition, the present invention may be variously modified by those skilled in the art to which the present invention pertains without departing from the gist of the present invention claimed in the claims.

INDUSTRIAL APPLICABILITY

According to the present invention, it is possible to effectively prevent the thermal stress concentration from occurring in the heat exchanger due to the unbalanced temperature distribution of the heat exchange medium. It is thus possible to greatly reduce the damage and crack occurring in the connection portions between the header and the tube by effectively dispersing the thermal stress. In addition, the header structure of the present invention can be formed by simply replacing a mold in a conventional header manufacturing process, and thus have excellent compatibility with the conventional header and heat exchanger manufacturing process.

The invention claimed is:

1. A heat exchanger comprising;

a pair of header tanks, wherein each of the pair of header tanks comprises a header and a tank, wherein the header and the tank are combined to have a shape of an enclosure, and wherein the pair of header tanks are positioned in parallel to each other but are spaced apart from each other by a predetermined distance; and a plurality of tubes each having both ends fixed to the header tanks to form a flow path of a refrigerant, wherein each header includes a bottom surface formed on a plane formed in a length direction and a width direction thereof, a side surface bent from the bottom surface and extending in a height direction thereof, a hole formation portion in which the plurality of tube insertion holes are formed, and an inner partial portion of the bottom surface protrudes into the header tank, an inner wall surface formed between the bottom surface and the hole formation portion, and a plurality of tube insertion holes into which a respective tube of the plurality of tubes is inserted into a respective tube insertion hole of the plurality of tube insertion holes, and wherein for at least one tube insertion hole of the plurality of tube insertion holes, each header includes a slope portion in which the inner wall surface is in contact with one of the tubes of the plurality of tubes, wherein the inner wall surface is inclined in a cross-section in the width direction at a position of the at least one tube insertion hole, wherein the slope portion has an angle inclined between the bottom surface and the inner wall surface in the cross-section in the width direction at the position of the at least one tube insertion hole, wherein the slope portion is formed over an entire range of the inner wall surface, or formed in a partial range of the inner wall surface adjacent to the at least one tube and a periphery connection portion in which the angle between the bottom surface and the inner wall surface is less inclined than the slope portion or perpendicular is formed in the remaining range of the inner wall surface, wherein each header includes a contact extension portion in which an inner partial region of the hole formation portion is recessed to the outside of a respective header tank of the pair of header tanks, wherein the contact extension portion is formed in a region including the at least one tube insertion hole having the slope portion formed therein, wherein in each header, the at least one tube insertion hole having the slope portion formed therein is only formed within a deformation range extending in the length direction from a position corresponding to a position of an inlet, through which the refrigerant is introduced into the respective header tank, wherein the deformation range has a value within a range of 40 to 60 mm.

2. The heat exchanger of claim 1, wherein the angle is an obtuse angle.

3. The heat exchanger of claim 1, wherein each header accommodates a gasket in a space formed between the side surface and the inner wall surface to secure airtightness between the respective header and the respective tank, and at least one of the plurality of tube insertion holes has no slope portion formed therein, and each header includes a misassembly prevention portion for preventing the gasket from being deviated from its correct position by having the angle between the bottom surface and the inner wall surface less inclined than the slope portion or perpendicular, in the cross section in the width direction at the position of the tube insertion hole having no slope portion.

4. The heat exchanger of claim 1, wherein each header accommodates a gasket in a space formed between the side surface and the inner wall surface to secure airtightness between the respective header and the respective tank, and includes a misassembly prevention portion for preventing the gasket from being deviated from its correct position by having the angle between the bottom surface and the inner wall surface less inclined than the slope portion or perpendicular, in the cross section in the width direction at a position between the tube insertion holes.

* * * * *